US009255361B2

(12) United States Patent
Gedevanishvili et al.

(10) Patent No.: US 9,255,361 B2
(45) Date of Patent: Feb. 9, 2016

(54) IN SITU FORMATION OF CATALYTIC CIGARETTE PAPER

(75) Inventors: Shalva Gedevanishvili, Richmond, VA (US); Shahryar Rabiei, Richmond, VA (US)

(73) Assignee: PHILIP MORRIS USA INC., Richmond, VA (US)

( * ) Notice: Subject to any disclaimer, the term of this patent is extended or adjusted under 35 U.S.C. 154(b) by 1979 days.

(21) Appl. No.: 11/729,951

(22) Filed: Mar. 30, 2007

(65) Prior Publication Data

US 2007/0251658 A1 Nov. 1, 2007

Related U.S. Application Data

(60) Provisional application No. 60/787,507, filed on Mar. 31, 2006.

(51) Int. Cl.

| | |
|---|---|
| ***A24B 15/18*** | (2006.01) |
| ***D21F 11/00*** | (2006.01) |
| ***A24B 15/28*** | (2006.01) |
| ***A24D 1/02*** | (2006.01) |
| ***D21H 21/14*** | (2006.01) |
| *D21H 19/06* | (2006.01) |
| *D21H 27/00* | (2006.01) |

(52) U.S. Cl.

CPC ..... *D21F 11/00* (2013.01); *A24B 15/282* (2013.01); *A24B 15/288* (2013.01); *A24D 1/02* (2013.01); *D21H 21/14* (2013.01); *D21H 19/06* (2013.01); *D21H 27/00* (2013.01)

(58) Field of Classification Search

None

See application file for complete search history.

(56) References Cited

U.S. PATENT DOCUMENTS

| | | | |
|---|---|---|---|
| 2,755,207 | A | 7/1956 | Frankenburg |
| 4,108,151 | A | 8/1978 | Martin et al. |
| 4,193,412 | A | 3/1980 | Heim et al. |
| 4,248,251 | A | 2/1981 | Bryant, Jr. et al. |
| 4,450,847 | A | 5/1984 | Owens |
| 4,744,374 | A | 5/1988 | Deffeves et al. |
| 5,143,098 | A | 9/1992 | Rogers et al. |
| 5,211,684 | A | 5/1993 | Shannon et al. |

(Continued)

FOREIGN PATENT DOCUMENTS

| | | | |
|---|---|---|---|
| WO | WO98/16125 | A | 4/1998 |
| WO | WO02/24006 | A | 3/2002 |

(Continued)

OTHER PUBLICATIONS

International Search Report and Written Opinion dated Mar. 28, 2008 for PCT/IB2007/002163.

(Continued)

*Primary Examiner* — Richard Crispino
*Assistant Examiner* — Phu Nguyen
(74) *Attorney, Agent, or Firm* — Buchanan, Ingersoll & Rooney P.C.

(57) ABSTRACT

Methods for the in situ formation of catalyst particles in cigarette paper are provided. A catalyst precursor, which can be incorporated into the cigarette papermaking process or can be combined with cigarette paper after formation of the paper, can be decomposed to form catalyst particles that are incorporated within the cigarette paper. Cigarette paper comprising the catalyst particles can be used to form a cigarette. During the smoking of a cigarette comprising the catalyst particles the amount of carbon monoxide in the mainstream smoke of the cigarette can be reduced.

8 Claims, 4 Drawing Sheets

(56) References Cited

U.S. PATENT DOCUMENTS

| | | | |
|---|---|---|---|
| 5,322,075 | A | 6/1994 | Deevi et al. |
| 5,342,484 | A | 8/1994 | Cutright et al. |
| 5,345,951 | A | 9/1994 | Serrano et al. |
| 5,386,838 | A | 2/1995 | Quincy, III et al. |
| 5,388,594 | A | 2/1995 | Counts et al. |
| 5,474,095 | A | 12/1995 | Allen et al. |
| 5,499,636 | A | 3/1996 | Baggett, Jr. et al. |
| 5,540,242 | A | 7/1996 | Chao et al. |
| 5,591,368 | A | 1/1997 | Fleischhauer et al. |
| 5,666,976 | A | 9/1997 | Adams et al. |
| 5,671,758 | A | 9/1997 | Rongved |
| 5,692,525 | A | 12/1997 | Counts et al. |
| 5,692,526 | A | 12/1997 | Adams et al. |
| 5,915,387 | A | 6/1999 | Baggett, Jr. et al. |
| 5,934,289 | A | 8/1999 | Watkins et al. |
| 5,988,176 | A | 11/1999 | Baggett, Jr. et al. |
| 5,997,691 | A | 12/1999 | Gautam et al. |
| 6,026,820 | A | 2/2000 | Baggett, Jr. et al. |
| 6,053,176 | A | 4/2000 | Adams et al. |
| 6,138,684 | A | 10/2000 | Yamazaki et al. |
| 6,286,516 | B1 | 9/2001 | Bowen et al. |
| 6,371,127 | B1 | 4/2002 | Snaidr et al. |
| 2002/0002979 | A1 | 1/2002 | Bowen et al. |
| 2002/0062834 | A1 | 5/2002 | Snaidr et al. |
| 2003/0114298 | A1 | 6/2003 | Woodhead et al. |
| 2004/0020504 | A1 | 2/2004 | Snaidr et al. |
| 2004/0168695 | A1 | 9/2004 | Snaidr et al. |
| 2005/0022833 | A1* | 2/2005 | Gedevanishvili et al. .... 131/365 |
| 2005/0121045 | A1 | 6/2005 | Finlay et al. |
| 2005/0211259 | A1 | 9/2005 | Gedevanishvili |

FOREIGN PATENT DOCUMENTS

| | | |
|---|---|---|
| WO | WO02/37990 | 5/2002 |
| WO | WO03/202058 | 3/2003 |
| WO | WO2005/002370 A | 1/2005 |

OTHER PUBLICATIONS

Richard R. Baker, "Mechanism of Smoke Formation and Delivery", Recent Advances in Tobacco Science, vol. 6, pp. 184-224 (1980).

Richard R. Baker, "Variation of the Gas Formation Regions within a Cigarette Combustion Coal during the Smoking Cycle", Beitrage zur Tabakforschung International, vol. 11, No. 1, pp. 1-17, (1981).

International Preliminary Report on Patentability dated Sep. 30, 2008 for PCT/IB2007/002163.

* cited by examiner

IN SITU FORMATION OF CATALYTIC CIGARETTE PAPER

CROSS REFERENCE TO RELATED APPLICATION

This application claims priority under 35 U.S.C. §119(e) to U.S. provisional Application No. 60/787,507, filed Mar. 31, 2006, the entire content of which is incorporated herein by reference.

BACKGROUND

Cigarettes, such as cigarettes or cigars, produce both mainstream smoke during a puff and sidestream smoke during static burning. One constituent of both mainstream smoke and sidestream smoke is carbon monoxide (CO). The reduction of carbon monoxide in smoke is desirable.

Despite the developments to date, there remains a need for improved and more efficient methods for incorporating catalyst particles in cigarette paper in order to reduce the amount of carbon monoxide in the mainstream smoke of a cigarette during smoking.

SUMMARY

A preferred method of manufacturing cigarette paper comprises (i) supplying a cellulosic material to a first head box of a forming section of a papermaking machine, (ii) depositing an aqueous slurry from the first head box onto the forming section of the papermaking machine so as to form a base web of the cellulosic material, (iii) removing water from the base web so as to form an intermediate web, (iv) drying the intermediate web so as to form a finished web, (v) depositing a catalyst precursor on at least one of the base web, the intermediate web or the finished web to form a catalyst precursor-infiltrated web, and (vi) treating the catalyst precursor-infiltrated web to form catalyst particles that are incorporated in and/or on the cellulosic material.

Preferably a solution comprising the catalyst precursor is deposited on the base web or the intermediate web, though a dried (e.g., powdered) catalyst precursor can be deposited. The method includes drying the precursor-infiltrated web at a temperature sufficient to thermally decompose the catalyst precursor to form catalyst particles or treating the precursor-infiltrated web with water so as to hydrolyze the catalyst precursor to form catalyst particles.

A method of manufacturing a bi-layer cigarette paper comprises (i) depositing a first layer of the bi-layer cigarette paper from a first head box onto a wire of a papermaking machine (ii) depositing a second layer of the bi-layer cigarette paper from a second head box onto a portion of the first layer, the second head box including a catalyst precursor, and (iii) removing water from the first layer and the second layer so as to form a single sheet of intermediate web.

BRIEF DESCRIPTION OF THE DRAWINGS

FIG. 2(*b*) shows a magnified view of the wrapper.

FIG. 3(*b*) shows a magnified view of the first wrapper with a second outermost wrapper.

FIG. 4(*b*) shows a magnified view of the wrapper.

DETAILED DESCRIPTION OF PREFERRED EMBODIMENTS

Figure 1:
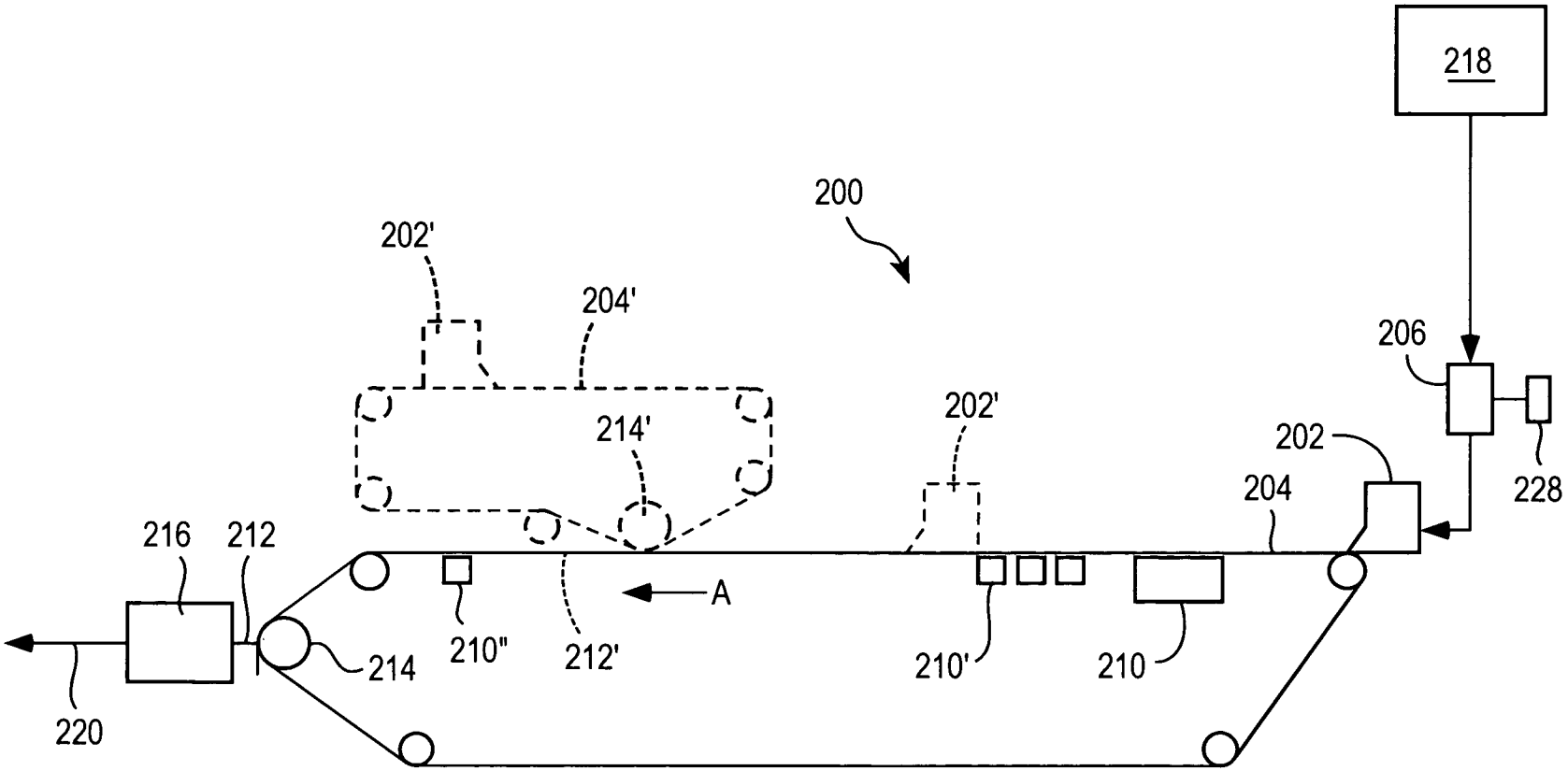
FIG. 1 shows a schematic of a papermaking machine.

Methods for the in situ formation of catalyst particles in cigarette paper are provided. A catalyst precursor is incorporated into the cigarette papermaking process or is combined with cigarette paper after formation of the paper but prior to incorporating the cigarette paper into a cigarette. Preferably, a catalyst precursor (e.g., a solution comprising the catalyst precursor) is incorporated into the cigarette papermaking process. A catalyst precursor solution (or liquid catalyst precursor) can penetrate the fibers of the cellulose-based web of the cigarette paper and distribute catalyst precursor throughout a base web, an intermediate web or a finished web. The paper web comprises cellulose fibers and fibrils.

Through subsequent thermal processing and/or reaction with water, the catalyst precursor can decompose to form the catalyst particles. The catalyst particles, which can be nanoscale particles, are incorporated in and/or on the fibrous web of the cigarette paper. Decomposition of the catalyst precursor and the in situ formation of the catalyst particles can be used to produce catalytic paper. The catalytic paper, which is typically consumed during smoking, can be used to form a lit-end cigarette. In a preferred embodiment, the catalytic paper is formed around a column of tobacco to form a tobacco rod. In a further embodiment, the catalytic paper is incorporated as shredded filler in the tobacco cut filler used to form a tobacco rod.

After the catalyst precursor is incorporated in and/or on the paper web, catalyst particles are formed from the decomposition of the catalyst precursor. One class of catalyst precursors can decompose through thermal processing (i.e., a paper web comprising the catalyst precursor can be heated to a temperature effective to thermally decompose the precursor and form catalyst particles). A second class of catalyst precursors can decompose via reaction with water (e.g., moisture present in, or added to, the paper web can initiate hydrolysis and condensation reactions that result in the formation of catalyst particles from the catalyst precursor).

Because the catalyst precursor can be intimately mixed with the fibers of the paper (e.g., a solution of the catalyst precursor can infiltrate the fibers of the paper web) catalyst particles that form via decomposition of the catalyst precursor can be intimately dispersed within the paper web.

Cigarette paper comprises a web of cellulosic fibers held together by hydrogen bonding. The paper web can comprise cellulose in the form of fibers, fibrils, microfibrils, or combinations thereof. Fibrils are the threadlike components that make up the wall of a cellulose fiber. Individual fibers and fibrils can be seen using an optical microscope. Upon examination by electron microscopy fibrils are found to consist of still finer fibrils.

The catalyst particles can be formed on the surface of individual fibers or fibrils. Thus, the catalyst particles can be formed on the surface of the paper and, advantageously, the catalyst particles can be formed throughout the matrix of the paper. For example, because the catalyst precursor can permeate the paper web, catalyst particles can be formed in a space between fibers (or fibrils) within the paper web. Also, the catalyst particles can be formed in a hollow space within an individual fiber (e.g., the catalyst precursor solution can permeate the fiber wall and, upon decomposition of the catalyst precursor, catalyst particles can form within the hollow core of a cellulose fiber. The catalyst particles can be in the form of individual particles and/or agglomerated particles.

Catalyst particles can be formed spontaneously upon combining a catalyst precursor with a paper web and/or through additional processing of the catalyst precursor/paper web mixture. A catalyst precursor can be incorporated into the paper web as dried powder (e.g., by sprinkling or dusting the catalyst precursor on a base web, intermediate web or finished web), as a neat liquid (e.g., the catalyst precursor can be a liquid compound that is incorporated into the cigarette paper web without using a solvent to dilute or disperse the catalyst precursor compound) or, more preferably, as a solution comprising the catalyst precursor.

Preferred catalyst precursors are high-purity, non-toxic and easy to handle and store. Desirable physical properties include solubility in solvent systems, compatibility with other catalyst precursors and volatility for low temperature processing.

A variety of compounds can be used as the catalyst precursor. For example, the catalyst precursor can be a metal salt (e.g., a soluble metal salt) such as a metal citrate, hydride, thiolate, amide, nitrate, oxalate, carbonate, cyanate, sulfate, bromide, chloride, as well as hydrates thereof.

A metal salt can thermally decompose to form catalyst particles. A paper web comprising a metal salt can be heated during or after formation of the paper web at a temperature effective to decompose the metal salt.

The catalyst particles can be formed via thermal decomposition during the papermaking process. In embodiments where the catalyst particles are formed via thermal decomposition during the papermaking process, preferably the temperature used is sufficiently high to decompose the catalyst precursor compound to form catalyst particles but sufficiently low to so as to avoid thermally degrading the paper.

The catalyst precursor, which is incorporated into the paper web, is preferably heated to decompose the precursor to form the catalyst particles prior to forming a cigarette comprising the paper.

Exemplary metal salts include iron nitrate, copper nitrate, manganese nitrate, cerium nitrate and the hydrates thereof.

In further embodiments, the catalyst precursor can be a metal organic compound. A metal organic compound can decompose to form catalyst particles via thermal decomposition or treatment with water.

Metal organic compounds have a central main group, transition, lanthanide, or actinide metal atom or atoms bonded to a bridging atom (e.g., N, O, P or S) that is in turn bonded to an organic radical. Examples of the main group metal atom ("M") include, but are not limited to Group IIA elements (Mg); IIIB elements (B, Al); Group IVB elements (Si, Ge, Sn); Group IVA elements (Ti, Zr, Hf); Group VA elements (V, Nb, Ta); Group VIA elements (Cr, Mo, W); Group VIIA elements (Mn, Re); Group VIIIA elements (Fe, Co, Ni, Ru, Rh, Pd, Os, Ir, Pt); Group IB elements (Cu, Ag, Au); Zn, Y and/or Ce. Such compounds may include metal alkoxides, β-diketonates, carboxylates and oxalates. The catalyst precursor can also be a so-called organometallic compound, wherein a central metal atom is bonded to one or more oxygen atoms of an organic group. One or more catalyst precursors can be incorporated into the papermaking process. Aspects of processing with these catalyst precursors are discussed below.

The catalyst precursors are advantageously molecules having pre-existing metal-oxygen bonds such as metal alkoxides $M(OR)_n$ or oxoalkoxides $MO(OR)_n$ (R=saturated or unsaturated organic group, alkyl or aryl), M(β-diketonate)$_n$ (β-diketonate=RCOCHCOR'), and metal carboxylates $M(O_2CR)_n$. These compounds can react with water to form metal oxide and/or metal oxyhydroxide catalyst particles.

Most metal alkoxides are solids at room temperature and standard pressure, though certain metal alkoxides (e.g., titanium ethoxide and tantalum ethoxide) are liquids. Metal alkoxides typically have both good solubility and volatility. However, metal alkoxides are generally highly hygroscopic and require storage under inert atmosphere. On the other hand, the high reactivity of the metal-alkoxide bond can make these compounds useful as starting compounds for a variety of heteroleptic species (i.e., species with different types of ligands) such as $M(OR)_{n-x}Z_x$ (Z=β-diketonate or $O_2CR$).

Metal alkoxides M(OR)N react easily with the protons of a large variety of molecules. This allows facile chemical modification and control of stoichiometry of the precursor compounds and their decomposition products by using, for example, organic hydroxy compounds such as alcohols, silanols ($R_3SiOH$), glycols $OH(CH_2)_nOH$, carboxylic and hydroxycarboxylic acids, hydroxyl surfactants, etc.

Modification of metal alkoxides can reduce the number of M-OR bonds available for hydrolysis and thus hydrolytic susceptibility. Thus, it is possible to control chemistry of a solution comprising a metal alkoxide by using, for example, β-diketonates (e.g., acetylacetone) or carboxylic acids (e.g., acetic acid) as modifiers for, or in lieu of, the —OR moiety.

Metal β-diketonates $[M(RCOCHCOR')_n]_m$ are attractive catalyst precursors because of their volatility and high solubility. Their volatility is governed largely by the bulk of the R and R' groups as well as the nature of the metal, which will determine the degree of association, m, represented in the formula above. Metal β-diketonates are prone to a chelating behavior that can lead to a decrease in the nuclearity of these precursors. Acetylacetonates (R=R'=$CH_3$) are advantageous catalyst precursors because they can provide good yield of metal oxide catalyst particles.

Metal carboxylates such as acetates ($M(O_2CCH_3)_n$) are commercially available as hydrates, which can be rendered anhydrous by heating with acetic anhydride or with 2-methoxyethanol. Many metal carboxylates generally have poor solubility in organic solvents and, because carboxylate ligands act mostly as bridging-chelating ligands, readily form oligomers or polymers. However, 2-ethylhexanoates ($M(O_2CCHEt_nBu)_n$), which are the carboxylates with the smallest number of carbon atoms, are generally soluble in most organic solvents. A large number of carboxylate derivatives are available for aluminum. For example, formate $Al(O_2CH)_3(H_2O)$ and carboxylate-alumoxanes $[AlO_x(OH)_y(O_2CR)_z]_m$ can be prepared from the inexpensive minerals gibsite or boehmite.

As noted above, catalyst precursors can be incorporated into cigarette paper as solids or neat liquids. In a preferred embodiment, however, a solution comprising at least one catalyst precursor (i.e., a catalyst precursor solution) is incorporated in the cellulosic material of the paper web during processing of the web or after formation of a finished web. A solution comprising at least one catalyst precursor can have any suitable concentration, e.g., 1 to 60 wt. %, preferably 5 to 50 wt. % of the catalyst precursor in a suitable solvent.

Any number of solvents can be used to form the catalyst precursor solution. Preferred solvents are selected based on a number of criteria including high solubility for the catalyst precursor, chemical inertness to the catalyst precursor, rheological compatibility with the paper web (e.g., the desired wettability and/or compatibility with other rheology adjusters), boiling point, vapor pressure and rate of vaporization, and economic factors (e.g., cost, recoverability, toxicity, etc.).

Solvents that may be used include water (e.g., de-ionized water), pentanes, hexanes, cyclohexanes, xylenes, ethyl acetates, toluene, benzenes, tetrahydrofuran, acetone, carbon disulfide, dichlorobenzenes, nitrobenzenes, pyridine, chloroform, mineral spirits and alcohols such as methyl alcohol, ethyl alcohol, propyl alcohol, isopropyl alcohol and butyl alcohol, and mixtures thereof.

Metal organic precursors such as metal alkoxides and the like that are incorporated into the papermaking process can form catalyst particles via hydrolysis and condensation reactions when the catalyst precursor reacts with moisture in the cigarette paper web. Alternatively, or in addition to forming the catalyst particles prior to forming the catalytic paper into a cigarette, a catalyst precursor can react with moisture in cigarette smoke during smoking of a cigarette comprising precursor-infiltrated paper to form catalyst particles. For example, titanium isopropoxide can react with water to form titanium oxide particles and propyl alcohol according to the reaction: $Ti(OC_3H_7)_4+2H_2O \rightarrow TiO_2+4C_3H_8O$.

The liquid products that are formed during hydrolysis and condensation of a metal organic compound (e.g., propyl alcohol that is formed via the hydrolysis and condensation of titanium isopropoxide) may be substantially removed from the paper web by vacuum, such as by reducing the pressure of the atmosphere surrounding the paper web, or by convection such as by increasing the temperature of the web. Furthermore, heating the paper web/catalyst precursor mixture can increase the rate of decomposition of the catalyst precursor and the concomitant rate of production of catalyst particles. In order to dry the paper web, preferably the paper web/catalyst precursor mixture is heated to a temperature higher than the boiling point of the liquid(s), e.g., from about 0 to 100° C., preferably about 40 to 80° C.

One or more catalyst precursors, which may form catalyst particles via thermal degradation and/or hydrolysis/condensation, can be used to incorporate catalyst particles in cigarette paper.

During smoking of a cigarette comprising catalytic paper, the catalyst particles can catalyze or react with one or more gas phase constituents in order to reduce the concentration of the gas phase constituents in the mainstream or sidestream smoke during smoking. For example, the catalyst particles can catalyze the oxidation of CO to $CO_2$ in the presence of oxygen (e.g., oxygen present in the mainstream smoke) in order to reduce the level of CO in mainstream and/or sidestream smoke. It is also believed that subsequent to the catalytic reaction, the catalyst particles can oxidize CO in the absence of an external source of oxygen in the gas stream to reduce the level of CO in the mainstream and/or sidestream smoke. For example, the catalyst particles can oxidize CO by donating oxygen to affect the conversion of CO to $CO_2$.

Preferably the catalyst precursor is incorporated in cigarette paper in an amount effective to form a catalytically effective amount of catalyst particles upon decomposition of the catalyst precursor. A catalytically effective amount of catalyst particles is an amount effective to catalyze at least 5%, more preferably at least 20%, of the carbon monoxide in mainstream smoke to carbon dioxide. The catalyst particles are preferably incorporated in cigarette paper in an amount effective to reduce the concentration in mainstream smoke of carbon monoxide by at least 5% (e.g., by at least 10%, 15%, 20%, 25%, 30%, 35%, 40%, 45%, 50%, 55%, 60%, 65%, 70%, 75%, 80%, 85%, 90% or 95%) in cigarettes comprising the catalytic paper.

Several factors contribute to the formation of carbon monoxide in a cigarette. In addition to the constituents in the tobacco, the temperature and the oxygen concentration in a cigarette during combustion can affect the formation and reaction of carbon monoxide and carbon dioxide. The total amount of carbon monoxide formed during smoking comes from a combination of three main sources: thermal decomposition (about 30%), combustion (about 36%) and reduction of carbon dioxide with carbonized tobacco (at least 23%).

Formation of carbon monoxide from thermal decomposition, which is largely controlled by chemical kinetics, starts at a temperature of about 180° C. and finishes at about 1050° C. Formation of carbon monoxide and carbon dioxide during combustion is controlled largely by the diffusion of oxygen to the surface of a fuel source (e.g., tobacco) ($k_a$) and via a surface reaction ($k_b$). At 250° C., $k_a$ and $k_b$, are about the same. At 400° C., the reaction becomes diffusion controlled. Finally, the reduction of carbon dioxide with carbonized tobacco or charcoal occurs at temperatures around 390° C. and above.

During smoking there are three distinct regions in a cigarette: the combustion zone, the pyrolysis/distillation zone, and the condensation/filtration zone. While not wishing to be bound by theory, it is believed that the catalyst particles that are formed in and incorporated in the catalytic paper can target the various reactions that occur in different regions of the cigarette during smoking. The catalyst particles can convert CO to $CO_2$ in the absence or presence of an external source of oxygen.

First, the combustion zone is the burning zone of the cigarette produced during smoking of the cigarette, usually at the lighted end of the cigarette. The temperature in the combustion zone ranges from about 700° C. to about 950° C., and the heating rate can be as high as 500° C./second. The concentration of oxygen is low in the combustion zone because oxygen is being consumed in the combustion of tobacco to produce carbon monoxide, carbon dioxide, water vapor and various organic compounds. The low oxygen concentration coupled with the high temperature leads to the reduction of carbon dioxide to carbon monoxide by the carbonized tobacco. In this region, the catalyst particles can convert carbon monoxide to carbon dioxide via an oxidation and/or catalysis mechanism. The combustion zone is highly exothermic and the heat generated is carried to the pyrolysis/distillation zone.

The pyrolysis zone is the region behind the combustion zone, where the temperature ranges from about 200° C. to about 600° C. The pyrolysis zone is where most of the carbon monoxide is produced. The major reaction is the pyrolysis (i.e., the thermal degradation) of the tobacco that produces carbon monoxide, carbon dioxide, smoke components and charcoal using the heat generated in the combustion zone. There is some oxygen present in this region, and thus the catalyst particle-containing cigarette paper may catalyze the oxidation of carbon monoxide to carbon dioxide. The catalytic reaction begins at about 50° C. and reaches maximum activity around 150 to 300° C. In the pyrolysis zone catalyst particles in the cigarette paper can directly oxidize the conversion of CO to $CO_2$.

In the condensation/filtration zone the temperature ranges from ambient to about 150° C. The major process in this zone is the condensation/filtration of the smoke components. Some amount of carbon monoxide and carbon dioxide diffuse out of the cigarette and some oxygen diffuses into the cigarette. The partial pressure of oxygen in the condensation/filtration zone does not generally recover to the atmospheric level. In the condensation/filtration zone, the catalyst particles can catalyze the conversion of carbon monoxide to carbon dioxide.

During the smoking of a cigarette, carbon monoxide in mainstream smoke flows toward the filter end of the cigarette.

As carbon monoxide travels within the cigarette, oxygen diffuses into and carbon monoxide diffuses out of the cigarette through the wrapper. After a typical 2-second puff of a cigarette, CO is concentrated in the periphery of the cigarette, i.e., near the cigarette wrapper, in front of the combustion zone. Due to diffusion of $O_2$ into the cigarette, the oxygen concentration is also high in the peripheral region.

Airflow into the tobacco rod is greatest near the combustion zone at the periphery of the cigarette and is approximately commensurate with the gradient of temperature, i.e., higher airflow is associated with larger temperature gradients. In a typical cigarette, the highest temperature gradient is from the combustion zone (>850-900° C.) axially toward the filter end of the cigarette. Within a few millimeters behind the combustion zone the temperature drops to near ambient. Further information on airflow patterns, the formation of constituents in cigarettes during smoking and smoke formation and delivery can be found in Richard R. Baker, "Mechanism of Smoke Formation and Delivery", Recent Advances in Tobacco Science, vol. 6, pp. 184-224, (1980) and Richard R. Baker, "Variation of the Gas Formation Regions within a Cigarette Combustion Coal during the Smoking Cycle", Beiträge zur Tabakforschung International, vol. 11, no. 1, pp. 1-17, (1981), the contents of both are incorporated herein by reference.

The distribution (i.e., concentration and/or location) of catalyst particles in a wrapper can be selected as a function of the temperature and airflow characteristics exhibited in a burning cigarette in order to adjust, e.g., increase, decrease, minimize, or maximize the conversion rate of CO to $CO_2$, by incorporating a known amount of catalyst precursor material.

A catalyst precursor can be selected that decomposes to produce catalyst particles that operate in a given temperature range, and a wrapper can be manufactured in which the catalyst particles are incorporated in those portions of the wrapper that are predicted to coincide with the appropriate temperature for operation of the catalyst. As discussed in further detail below, the selective incorporation of catalyst particles can be realized by controlling the composition, concentration, distribution and/or amount of catalyst precursor that is used.

"Smoking" of a cigarette means the heating or combustion of the cigarette to form smoke, which can be drawn through the cigarette. Generally, smoking of a cigarette involves lighting one end of the cigarette and, while the tobacco contained therein undergoes a combustion reaction, drawing smoke from the combustion through the mouth end of the cigarette. The cigarette may also be smoked by other means. For example, the cigarette may be smoked by heating the cigarette and/or heating using an electrical smoking system as described in commonly-assigned U.S. Pat. Nos. 6,053,176; 5,934,289; 5,591,368 or 5,322,075, the contents of which are incorporated herein in their entirety.

As used herein, a catalyst is capable of affecting the rate of a chemical reaction, e.g., a catalyst can increase the rate of oxidation of carbon monoxide to carbon dioxide without participating as a reactant or product of the reaction. An oxidant is capable of oxidizing a reactant, e.g., by donating oxygen to the reactant, such that the oxidant itself is reduced. A reducing agent is capable of reducing a reactant, e.g., by receiving oxygen from the reactant, such that the reducing agent itself is oxidized.

By "incorporated in" is meant that the catalyst particles comprise a second phase that is dispersed at least partially throughout the matrix of the cigarette paper. Catalyst particles that are formed in situ can lie between the cellulosic fibers of the paper web and/or within the pores of the cellulosic fibers. The paper web can support the catalyst particles such that the catalyst particles are at least partially, preferably totally, enveloped by the paper web. That is, in a preferred embodiment, catalyst particles that are formed in situ are at least partially embedded within the cellulosic web of the paper. By "incorporated on" is meant that the catalyst particles comprise a second phase that is dispersed on a surface of the cigarette paper (i.e., the catalyst particles are supported by the paper web).

The catalyst particles preferably comprise an oxide and/or oxyhydroxide of at least one element (e.g., B, Mg, Al, Si, Ti, V, Cr, Mn, Fe, Co, Ni, Cu, Zn, Ge, Y, Zr, Nb, Mo, Ru, Rh, Pd, Ag, Sn, Ce, Hf, Ta, W, Re, Os, Ir, Pt or Au). Preferred catalyst particles comprise the oxides and/or oxyhydroxides of titanium, manganese or iron.

By "oxyhydroxide" is meant a compound containing a hydroperoxo moiety, i.e., "—O—O—H." Particularly preferred oxyhydroxides include TiO(OH), MnO(OH) and FeO(OH). Iron oxyhydroxide is preferably in the form of α-FeO(OH) (goethite); however, other forms of FeO(OH) such as β-FeO(OH) (akaganeite), γ-FeO(OH) (lepidocrocite) and γ'-FeO(OH) (feroxyhite) may also be formed. Iron oxyhydroxide can produce one or more iron oxides (e.g., $Fe_2O_3$, $Fe_3O_4$ and/or FeO) upon thermal degradation. The oxides of iron, and in particular $Fe_2O_3$, can catalyze and oxidize carbon monoxide to carbon dioxide.

Without wishing to be bound by theory, it is believed that metal oxides and metal oxyhydroxides can catalyze and/or oxidize the conversion of CO to $CO_2$. Furthermore, oxyhydroxide compounds that are incorporated in cigarette paper used in a lit-end cigarette may decompose during smoking of the cigarette to form metal oxides according to the following reaction where M represents one of the aforementioned elements: $2\ MO(OH) \rightarrow M_2O_3 + H_2O$. Oxyhydroxide catalyst particles can thermally decompose to form metal oxide catalyst particles.

The papermaking process can be carried out using conventional papermaking equipment. Catalytic paper may be made using ordinary paper furnish such as pulped wood, flax fibers, or any standard cellulosic fiber. An exemplary method of manufacturing cigarette paper comprises supplying a cellulosic material and a catalyst precursor to a papermaking machine and forming the cigarette paper by depositing (e.g., co-depositing or sequentially depositing) the cellulosic material and the catalyst precursor.

In an embodiment, aqueous slurry including a catalyst precursor and cellulosic material is supplied to a head box of a forming section of a Fourdrinier papermaking machine. The cellulosic material/catalyst precursor mixture is deposited from the head box onto a forming section so as to form a base web comprising cellulosic material and catalyst precursor.

In an alternative embodiment, the cellulosic material and catalyst precursor can be deposited sequentially. For example, slurry of cellulosic material from a first head box can be deposited to form a base web and a catalyst precursor can be deposited onto the base web, a partially-dried base-web (i.e., an intermediate web) or a fully-dried web (i.e., a finished web). Preferably, a solution comprising a catalyst precursor is deposited onto the base web. The catalyst precursor solution can be deposited onto a paper web from a second head box.

In embodiments where the cellulosic material and the catalyst precursor are simultaneously deposited (e.g., from the same head box) the catalyst precursor can be any precursor suitable for forming an aqueous solution, suspension or slurry. In embodiments where a catalyst precursor is deposited onto an already formed paper web, the catalyst precursor (e.g., a catalyst precursor solution) can be deposited onto a wet, partially dried or dried base web of cellulosic material.

Referring to FIG. 1, a cigarette papermaking machine 200 includes a head box 202 operatively located at one end of a Fourdrinier wire 204, and a source of feedstock slurry such as a run tank 206 in fluid communication with the head box 202.

The head box 202 can be one typically used in the papermaking industry for laying down cellulosic pulp upon the Fourdrinier wire 204. In the usual context, the head box 202 is communicated to the run tank 206 through a plurality of conduits. The run tank 206 receives slurry from a supply tank 218. Preferably, the feedstock from the run tank 206 is a refined cellulosic pulp such as a refined flax or wood pulp. A chalk tank 228 (containing web-filler material) is in fluid communication with the run tank 206 so as to establish a desired "chalk" level in the slurry supplied to the head box 202.

In a typical Fourdrinier machine, the forming section comprises a forming wire that is configured as an endless wire immediately below the head box. Slurry comprising cellulosic material can flow through an opening in the lower portion of the head box adjacent to the endless wire and onto the top surface of the endless wire to from a wet base web.

After depositing the aqueous slurry onto the forming section, water is removed from the wet base web to form an intermediate web. The intermediate web can be dried and, if desired, pressed to form a finished web (e.g., a sheet of cigarette paper). The cigarette paper is subsequently taken up for storage or use, e.g., the cigarette paper can be coiled in a sheet or a roll.

The Fourdrinier wire 204 carries the laid slurry pulp (e.g., base web) from the head box 202 along a path in the general direction of arrow A in FIG. 1, whereupon water is allowed to drain from the pulp through the wire 204 by the influence of gravity and (optionally) with the assistance of vacuum boxes 210, 210', 210" at various locations along the Fourdrinier wire 204. At some point along the Fourdrinier wire 204 sufficient water is removed from the base web to establish what is commonly referred to as a dry line where the texture of the slurry transforms from one of a glossy, watery appearance to a surface appearance more approximating that of the finished base web (but in a wetted condition, e.g., an intermediate web). At and about the dry line, the moisture content of the pulp material is approximately 85 to 90%, which may vary depending upon operating conditions.

Downstream of the dry line, the intermediate web 212 is separated from the Fourdrinier wire 204 at a couch roll 214. From there, the Fourdrinier wire 204 continues on the return loop of its endless path. Beyond the couch roll 214, the intermediate web 212 continues on through the remainder of the papermaking system, which further dries and can press and condition the intermediate web 212 to a desired final moisture content and texture to form cigarette paper 220 (e.g., finished web). Such drying apparatus may include drying section 216 including drying felts, vacuum devices, rolls and/or presses, applied thermal energy, and the like.

Other papermaking processes can be used to make cigarette paper comprising catalyst particles. For example, a laminated, bi-layer or multi-layer paper can be made. Examples of bi-layer and multi-layer paper are disclosed in commonly-owned U.S. Pat. No. 5,143,098 the entire content of which is herein incorporated by reference. In embodiments of a bi-layer or multi-layer wrapper, preferably at least one of a radially inner layer and/or a radially outer layer can be formed to comprise at least one catalyst precursor as described herein.

To form multi-layer paper, the cigarette making machine 200 can include more than one head box and/or more than one Fourdrinier wire with either separate or common supplies. Referring still to FIG. 1, an optional second head box 202', suitably integrated with a run tank and slurry supply, can lay slurry pulp onto the slurry pulp laid from the first head box 202 and carried along Fourdrinier wire 204. The second and/or additional head box can be supplied with a catalyst precursor solution, or can be free of catalyst precursor. In cigarette making machines comprising more than one head box, catalyst precursor may be introduced from one or more of the head boxes.

An optional second Fourdrinier wire 204', suitably integrated with second head box 202' adapted for laying slurry pulp on the second Fourdrinier wire 204', and draining and drying equipment can form a second intermediate web 212'. The second intermediate web 212' can be separated from the second Fourdrinier wire 204' at a second couch roll 214' and laid on the first intermediate web 212 from the Fourdrinier wire 204 to be processed into double layer paper. Multiple optional Fourdrinier wires can be employed to form multiple layer paper having any desired number of layers, such as three, four and so forth, up to ten to twelve layers.

Preferred catalyst precursors, which can be incorporated into the head box and deposited simultaneously with the paper slurry include metal salts such as metal nitrates.

The single layer, bi-layer or multi-layer single sheet wrapper may be made using ordinary paper furnish such as pulped wood, flax fibers, or any standard cellulosic fiber. Different fillers, including different catalyst precursors and/or web-filler material, or different fibers may be used for each layer and may be contained in different head boxes. For example, a first head box can hold the materials for a wrapper that includes a catalyst precursor and a second head box can hold the materials for a conventional wrapper.

In another example of making bi-layer or multi-layer single sheet catalytic paper, a first head box can hold the materials for cigarette paper that includes a catalyst precursor at a first concentration or loading level and a second head box can hold the materials for cigarette paper that includes a catalyst precursor at a second concentration or loading level. Preferably, the first concentration or first loading level is different from the second concentration or second loading level. For example, the paper can have a radially inner layer and a radially outer layer, the radially inner layer having a first loading of the catalyst precursor and the radially outer layer having a second loading of the catalyst precursor. The first loading of the catalyst precursor can be greater than the second loading of the catalyst precursor. Thus, the first loading of catalyst particles can be greater than the second loading of catalyst particles.

Additional examples of papermaking processes include the method for making banded cigarette wrappers disclosed in commonly-owned U.S. Pat. No. 5,342,484, the entire content of which is herein incorporated by reference, and the method for producing paper having a plurality of regions of variable basis weight in the cross direction disclosed in commonly-owned U.S. Pat. Nos. 5,474,095 and 5,997,691, the entire contents of which are herein incorporated by reference.

Further and in the alternative to incorporating the catalyst precursor into the web of the paper during the papermaking process, it is contemplated that the paper (e.g., a paper wrapper) can be manufactured first and the catalyst precursor deposited onto a surface of the paper. For example, catalyst precursor material can be deposited directly onto a finished wrapper by dusting or spraying. Preferably the catalyst precursor permeates the wrapper prior to treating the catalyst precursor to form catalyst particles.

Because paper containing catalyst particles can be darker than catalyst particle-free paper, for cosmetic reasons catalyst precursors are preferably incorporated in the inner surface of a single-layer paper or in the radially innermost layer of a multi-layer paper.

Figures 2A, 2B:
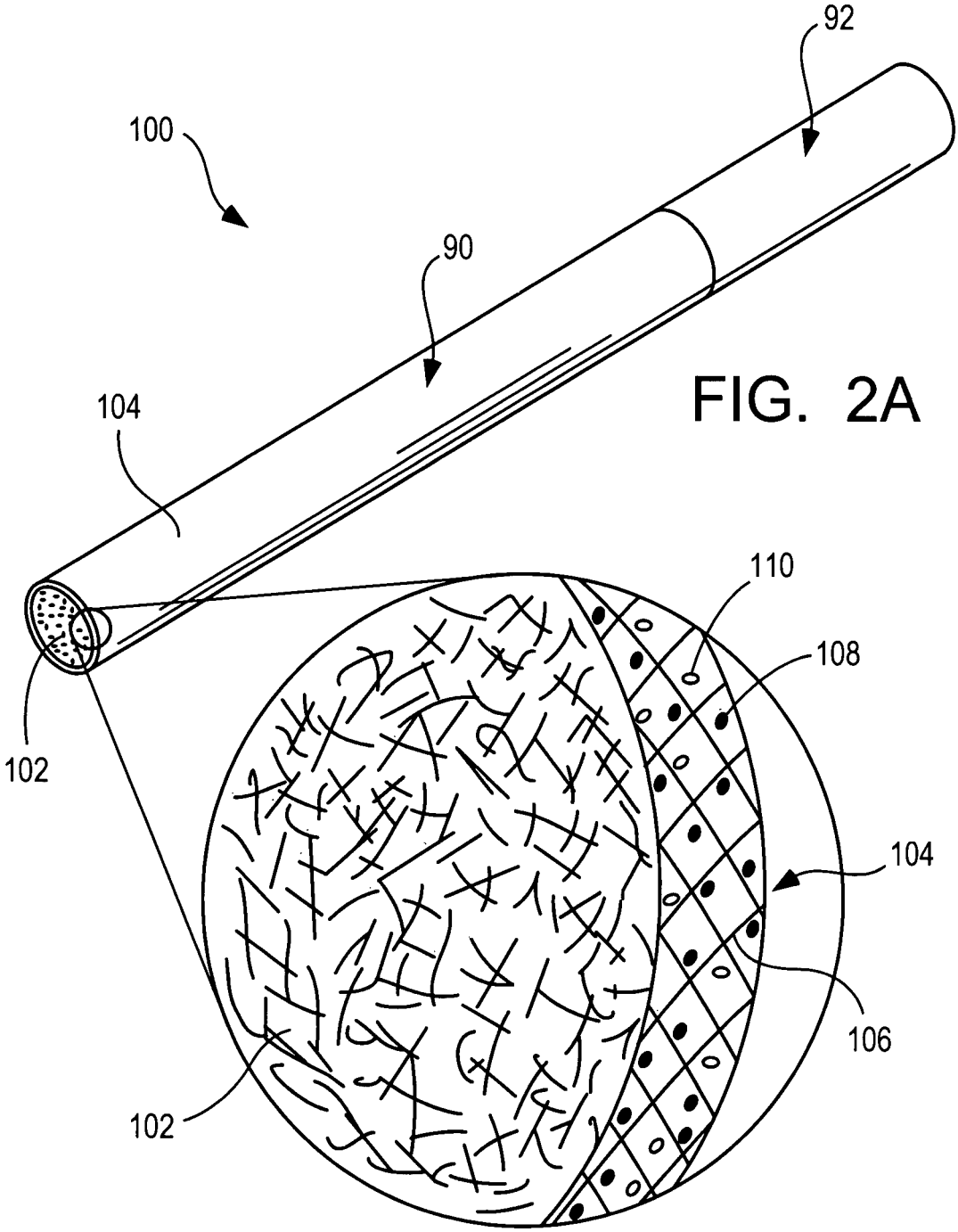
FIG. 2(*a*) shows an exemplary cigarette with catalyst particles supported on the base web of the wrapper.
Figures 3A, 3B:
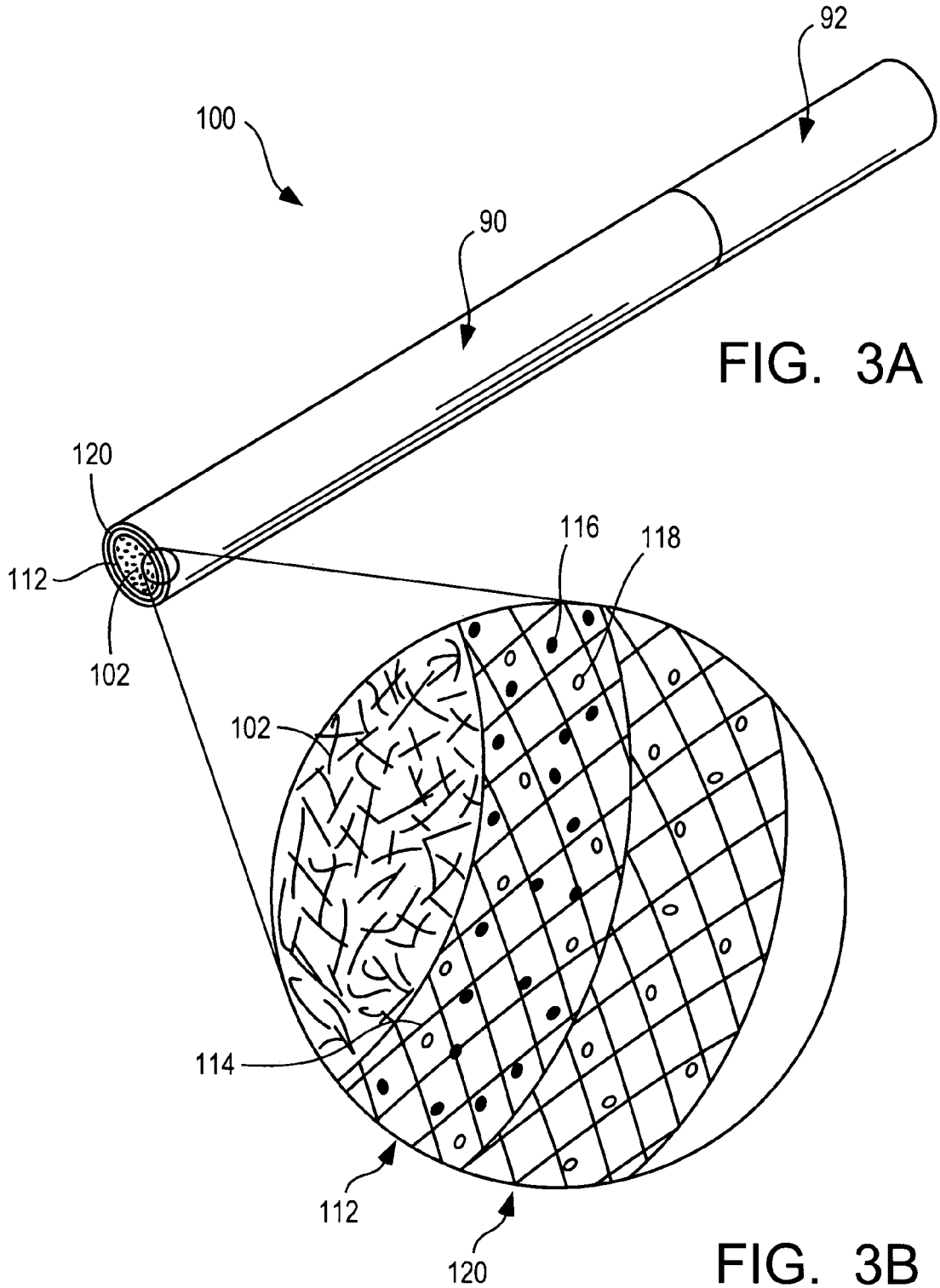
FIG. 3(*a*) shows an exemplary cigarette with catalyst particles supported on the base web of a first wrapper with a second outermost wrapper.
Figure 4A:
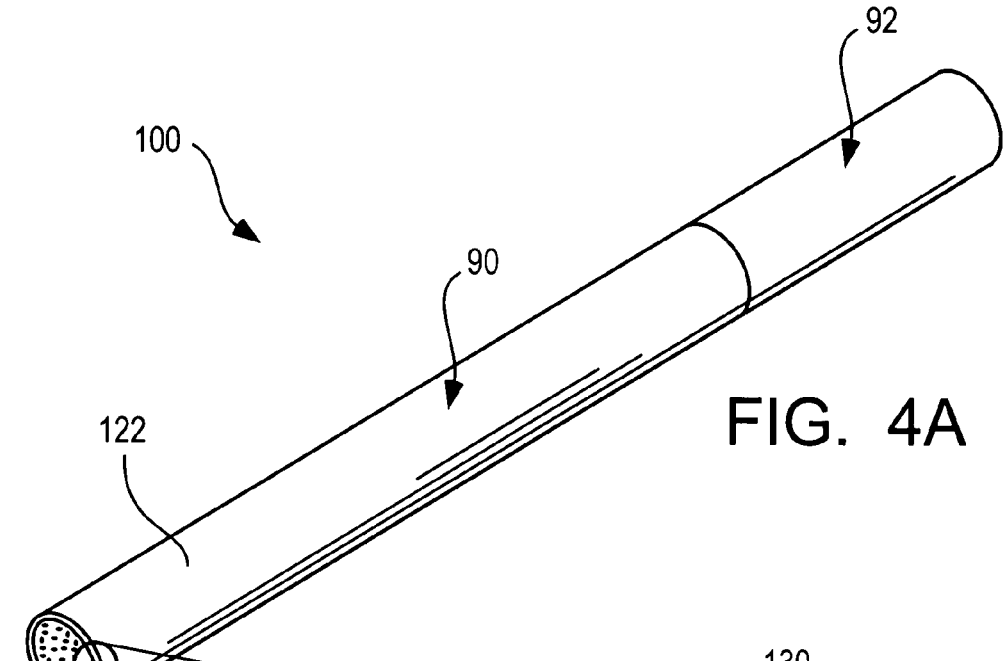
FIG. 4(*a*) shows an exemplary cigarette with a wrapper including catalyst particles supported on an inner web region of the wrapper.
Figure 4B:
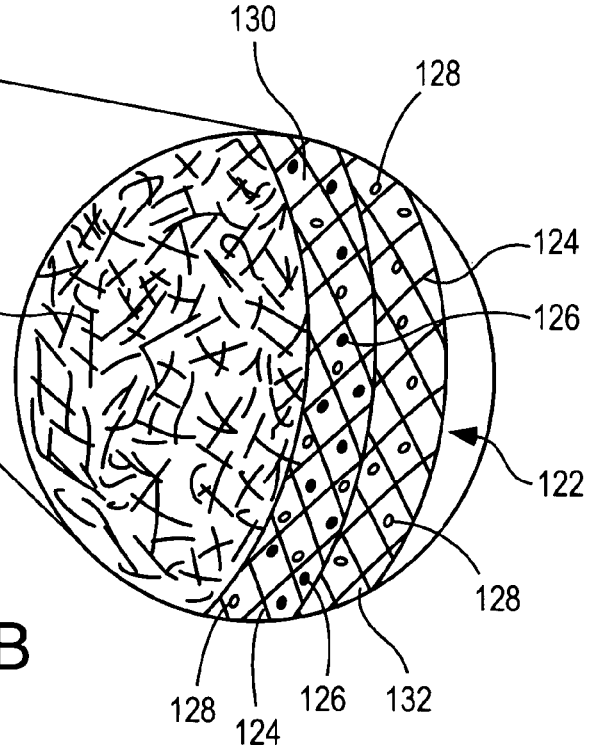

Embodiments of cigarettes comprising catalytic paper wrapper(s) are illustrated in FIGS. 2-4. Referring to FIG. 2(*a*), a cigarette 100 has a tobacco rod portion 90 and an optional filtering tip 92. The tobacco rod portion 90 comprises a column of tobacco 102 that is enwrapped with a cigarette (tobacco) wrapper 104.

As shown in expanded view in FIG. 2(*b*), the wrapper 104 includes a web of fibrous cellulosic material 106 in which is typically dispersed particles of web-filler material 110, such as calcium carbonate ($CaCO_3$). In practice, the web-filler material 110 serves as an agent for determining the permeability of the wrapper 104 (measured typically in units of Coresta, which is defined as the amount of air, measured in cubic centimeters, that passes through one square centimeter of material in one minute at a pressure drop of 1.0 kilopascals).

The web-filler material can include an oxide, a carbonate, or a hydroxide of a Group II, Group III or Group IV metal, or the web-filler material can be selected from the group consisting of $CaCO_3$, $TiO_2$, silicates such as $SiO_2$, $Al_2O_3$, $MgCO_3$, MgO and $Mg(OH)_2$. In a preferred example, the web-filler material is $CaCO_3$ or other conventional filler material used in cigarette paper manufacture. An average particle size of the web-filler material is about 0.1 to 10 microns, preferably less than or equal to 1.5 microns.

The paper wrapper in FIG. 2 further comprises catalyst particles 108 that are incorporated in and/or on the paper web. If desired, the wrapper paper or regions of the wrapper paper can include web-filler material that does not include catalyst particles.

FIGS. 3(*a*) and 3(*b*) show a cigarette comprising a first wrapper and a second wrapper. In the FIG. 3 embodiment, the cigarette 100 includes a cigarette tobacco column 102 surrounded by a first inner wrapper 112. The first inner wrapper is wrapped in a second, outer wrapper 120. As shown in expanded view in FIG. 3(*b*), the first and second wrappers include a web of fibrous cellulosic material 114 having incorporated therein web-filler material 118. The first inner wrapper 112 further comprises catalyst particles 116.

In FIG. 3, the inner wrapper and the outer wrapper are individual wrappers formed in separate papermaking processes and later wrapped around tobacco cut filler to from a cigarette tobacco rod. The inner wrapper, the outer wrapper or both wrappers can include the catalyst particles. In examples where both wrappers include catalyst particles, the specific composition and amount of the catalyst in each wrapper can be the same or different.

In embodiments of bi- or multi-layer cigarette paper, a total amount of catalyst particles incorporated in and/or on the first (e.g., inner) wrapper is about 50 to 200 mg or more per cigarette and a total amount of catalyst particles incorporated in and/or on the second wrapper is preferably less than about 50 mg, more preferably 0 mg per cigarette. Preferably the second wrapper 120 does not include catalyst particles so as to provide a cigarette 100 having an outward appearance that is not affected by any coloration from the catalyst particles.

A preferred ratio, in weight percent, of catalyst particles to a web-filler material in the first inner wrapper is preferably from about 0.1 to 3.0.

FIG. 4 shows a cigarette with a single-layer wrapper including catalyst particles incorporated therein. In the FIG. 4 embodiment, a catalyst precursor is incorporated in the wrapper to provide a gradient in the amount of catalyst particles through the thickness of the wrapper.

A gradient in the concentration of catalyst particles through the thickness of the paper can be provided by controlling the incorporation of catalyst precursor material in the paper web. For example, a solution comprising a catalyst precursor can penetrate the paper web to a greater extent than a powdered catalyst precursor that is dusted onto the paper web. Without wishing to be bound by theory, it is believed that catalyst particles formed from the decomposition of a powdered (i.e., dry) catalyst precursor will be localized closer to the surface of the paper than catalyst particles from the decomposition of a catalyst precursor solution. In a further example, it is believed that a solution comprising a catalyst precursor can penetrate a wet paper web to a greater extent than the same solution can penetrate a partially dried or dry web.

The cigarette 100 in FIG. 4(*a*) includes a tobacco rod portion 90 and an optional filter 92. The tobacco rod portion 92 comprises a column of tobacco 102 that is enwrapped with a cigarette (tobacco) wrapper 122. As shown in expanded view in FIG. 4(*b*), the wrapper 122, which comprises a web of fibrous cellulosic material 124, includes web filler material 128 and catalyst particles 126 that are incorporated in and/or on the paper web. The wrapper 122 has a radially inner portion 130 and a radially outer portion 132, the radially inner portion 130 having a first loading of the catalyst particles 126 and the radially outer portion 132 having a second loading of the catalyst particles. The first loading of the catalyst particles is preferably greater than the second loading of the catalyst particles. Preferably the concentration of catalyst particles is about zero at the outer surface of the wrapper. However, the loading of web-filler material can be constant across the thickness of the paper or the loading of web-filler material can be non-constant.

The catalyst particles can comprise micron-sized or nanoscale particles. By "nanoscale" is meant that the particles have an average particle diameter of less than a micron (e.g., less than about 500, 200, 100, 50 or 10 nm). A bulk density of the catalyst particles is preferably less than about 0.5 g/cc. The Brunauer, Emmett and Teller (BET) surface area of preferred catalyst particles is about 20 $m^2/g$ to 400 $m^2/g$ (e.g., from about 200 $m^2/g$ to 300 $m^2/g$).

As noted above, preferred catalyst particles comprise titanium, manganese and/or iron. For example, the catalyst particles can comprise amorphous and/or crystalline phases of the oxides and/or oxyhydroxides of titanium, manganese and/or iron. Iron oxide catalyst particles can comprise $\alpha$-FeO(OH), $\gamma$-FeO(OH), $\alpha$-$Fe_2O_3$, $\gamma$-$Fe_2O_3$, $Fe_3O_4$, FeO or mixtures thereof.

A total amount of catalyst particles per cigarette is preferably an amount effective to convert at least some CO to $CO_2$. A preferred amount of catalyst per cigarette is up to about 200 mg or more (e.g., at least about 50, 100 or 150 mg).

In one approach a catalyst precursor solution comprising a catalyst precursor is incorporated in a base web, intermediate web or finished web of cigarette paper during the papermaking process. For example, a catalyst precursor solution can be spray-coated onto a partially dried or dried base web. In a further approach, a catalyst precursor solution can be applied (e.g., spray-coated) onto at least one side of a cigarette paper after the paper is fully formed. In a still further approach, a catalyst precursor solution can be incorporated into the papermaking slurry that is used to form the cigarette paper. Combinations of these approaches can be used.

After incorporating a catalyst precursor solution into the paper web, at least one of thermal processing or exposure of the catalyst precursor to moisture are used to decompose the catalyst precursor and form the catalyst particles.

One method to decompose the catalyst precursor is to heat the paper web comprising the catalyst precursor with a heat source such as a radiation lamp. The catalyst precursor (e.g., one or more metal salts) preferably decomposes to form catalyst particles at a temperature of less than about 150° C., preferably less than about 100° C. The catalyst precursor-infiltrated base web can be heated in air or in an atmosphere comprising oxygen.

In a further method, catalyst particles can be formed from the catalyst precursor by exposing the catalyst precursor to moisture. Water present in the papermaking process or water introduced to a catalyst precursor-infiltrated web can react with the catalyst precursor to form catalyst particles.

In production of a cigarette, a paper wrapper is wrapped around cut filler to form a tobacco rod portion of the cigarette by a cigarette-making machine, which has previously been supplied or is continuously supplied with tobacco cut filler and one or more ribbons of wrapper.

In cigarette manufacture, the tobacco is normally employed in the form of cut filler, i.e., in the form of shreds or strands cut into widths ranging from about 1/10 inch to about 1/20 inch or even 1/40 inch. The lengths of the strands range from between about 0.25 inches to about 3.0 inches. The cigarettes may further comprise one or more flavorants or other additives (e.g., burn additives, combustion modifying agents, coloring agents, binders, etc.) known in the art.

Cigarettes may range from about 50 mm to about 120 mm in length. The circumference is from about 15 mm to about 30 mm, preferably about 25 mm. The tobacco packing density is typically from about 100 mg/cm$^3$ to 300 mg/cm$^3$, preferably from about 150 mg/cm$^3$ to 275 mg/cm$^3$.

The paper used to wrap a tobacco column to form the tobacco rod portion of a cigarette can comprise catalyst particles formed in situ in the paper from the decomposition of at least one catalyst precursor. In a second method, the paper used to form the tobacco column can comprise a catalyst precursor, which is treated to form catalyst particles in and/or on the paper wrapper after the paper wrapper is formed around the tobacco column. A catalyst precursor solution can be incorporated into (e.g., sprayed on) the paper wrapper after the paper wrapper is formed around the tobacco column.

The wrapper can be any suitable conventional wrapper. For example, a preferred wrapper can have a basis weight of from about 18 g/m$^2$ to about 60 g/m$^2$ and a permeability of from about 5 Coresta units to about 80 Coresta units. More preferably, the wrapper has a basis weight from about 30 g/m$^2$ to about 45 g/m$^2$ and the permeability is about 30 to 35 Coresta units. However, any suitable basis weight for the wrapper can be selected. For example, a higher basis weight, e.g., 35 to 45 g/m$^2$, can support a higher loading of catalyst particles. If a lower catalyst loading is selected, then a lower basis weight wrapper can be used. Other permeabilities of the wrapper can be selected based on the application and location of the wrapper.

The thickness of a single-layer wrapper is preferably from about 15 to 100 microns, more preferably from about 20 to 50 microns. Additional layers in a multi-layer wrapper can be from about 0.1 to 10 times the permeability of the first layer and can have a thickness of from about 0.1 to 2 times the thickness of the first layer. Both the permeability and the thickness of the first layer and the second layer can be selected to achieve a desired total air permeability and total thickness for the cigarette.

A wrapper can be any wrapping surrounding the cut filler, including wrappers containing flax, hemp, kenaf, esparto grass, rice straw, cellulose and so forth. Optional filler materials, flavor additives, and burning additives can be included in the wrapper. When supplied to the cigarette-making machine, the wrapper can be supplied from a single bobbin in a continuous sheet (a mono-wrap) or from multiple bobbins (a multi-wrap, such as a dual wrap from two bobbins).

The catalytic paper can be used as a wrapper for conventional cigarettes or non-conventional cigarettes such as cigarettes for electrical smoking systems described in commonly-assigned U.S. Pat. Nos. 6,026,820; 5,988,176; 5,915,387; 5,692,526; 5,692,525; 5,666,976; 5,499,636 and 5,388,594 or non-traditional types of cigarettes having a fuel rod such as are described in commonly-assigned U.S. Pat. No. 5,345,951.

If desired, the catalytic paper can be used at other locations and/or for any of the paper layers in a cigarette. The catalytic paper can surround the tobacco rod portion, be incorporated into a cellulosic component of the filter portion and/or incorporated into the tobacco rod as shredded filler. For example, the catalytic paper can be shredded and mixed with tobacco cut filler to form a composition of tobacco for manufacture into a catalyst-containing tobacco rod.

Any suitable tobacco mixture may be used for the cut filler. Examples of suitable types of tobacco materials include flue-cured, Burley, Bright, Maryland or Oriental tobaccos, the rare or specialty tobaccos, and blends thereof. The tobacco material can be provided in the form of tobacco lamina, processed tobacco materials such as volume expanded or puffed tobacco, processed tobacco stems such as cut-rolled or cut-puffed stems, reconstituted tobacco materials, or blends thereof. The tobacco can also include tobacco substitutes.

Preferred catalyst particles that are formed in and incorporated in paper for a cigarette are catalytically active at temperatures as low as ambient temperature and preferably remain catalytically active at temperatures as high as 900° C.

Cigarette paper (e.g., paper wrapper and/or paper filler) comprising catalyst particles can be incorporated along the entire axial length of the anticipated burn zone of a cigarette, i.e., not only at the filter end. Preferred cigarettes comprise catalytic paper that is catalytically active from the lit end to the filter end during use. The axial distribution of the catalyst can provide a contact time between the catalyst particles and the mainstream smoke that is effective to enable the particles to convert CO to $CO_2$.

In a further example, a mixed catalyst, e.g., a catalyst that is a combination of more than one catalyst composition that each operate at a different temperature range or overlapping temperature ranges, can be used to broaden the temperature range at which conversion of CO to $CO_2$ can occur and to increase the operating period of the catalyst as the cigarette is smoked. For example, a mixed catalyst may operate at both above about 500° C. and at 300° C. to 400° C. and thus can convert CO to $CO_2$ both at the burn zone and behind the burn zone, effectively increasing the conversion time and the area of the wrapper where conversion can occur.

Although the catalyst particles are described herein as having an operating temperature, the term operating temperature refers to the preferred temperature for conversion of CO to $CO_2$. The catalyst particles may still operate to convert CO to $CO_2$ outside the described temperature range.

Catalytic paper was prepared by spraying or pouring a catalyst precursor solution on pre-formed strips of cigarette paper. In a first example, the catalyst precursor solution was made by dissolving 100 g of $Fe(NO_3)_3.9H_2O$ in 100 ml of $H_2O$. After spraying the cigarette paper with the nitrate solution, the coated paper strips were heat treated at a temperature of 150° C. for 60 minutes under an applied load (to minimize wrinkling of the paper) in order to decompose the ferric nitrate and form catalyst particles comprising oxides of iron. The weight gain of the paper, due to the incorporation of catalyst particles, was about 0.7 mg/cm$^2$.

In a second example, catalyst particles comprising iron oxides were formed in situ by spraying-coating strips of cigarette paper with an alcoholic solution of iron ethoxide (466 mg of $Fe(OCH_2CH_3)_3$ dissolved in 100 ml of $CH_3CH_2OH$). The iron ethoxide-infiltrated web was dried at room temperature to form iron oxide catalyst particles. The weight gain of the paper strips, due to the incorporation of catalyst particles after drying in ambient air, was about 0.2 mg/cm$^2$.

In a third example, 50 ml of iron ethyl hexanoisopropoxide was spray-coated onto cigarette paper strips. The iron ethyl hexanoisopropoxide-infiltrated web was dried at room temperature to form iron oxide catalyst particles. The loading of catalyst particles in the paper strips was about 2.8 mg/cm$^2$.

In a fourth example, a catalyst precursor solution comprising 466 mg of manganese (II) methoxide dissolved in 100 ml of ethanol was poured over strips of cigarette paper. The infiltrated paper strips were dried in ambient air. The manganese methoxide precursor was decomposed to form manganese oxide catalyst particles by drying the precursor-infiltrated paper at room temperature. The weight gain of the paper due to the incorporation of manganese oxide catalyst particles was about 0.04 mg/cm$^2$.

In addition, any of the cigarette papers described herein can include additional additives used in wrappers and/or paper filler for cigarettes. These additives can include, for example, additives to control the appearance, e.g., color of the wrapper, additives to control the burn rate of the wrapper, and/or additives incorporated in an amount effective to control the ash appearance of a lit end cigarette.

Cigarette paper comprising catalyst particles that are formed in situ in the cigarette paper can be used to selectively remove carbon monoxide from mainstream and/or sidestream cigarette smoke. For example, catalyst particles incorporated in a paper wrapper can preferentially catalyze and/or oxidize the conversion of mainstream gases that come into contact with the catalyst particles.

A method of making a cigarette comprises (i) providing tobacco cut filler to a cigarette making machine to form a tobacco column; (ii) placing catalytic cigarette paper around the tobacco column to form a tobacco rod of a cigarette, and (iii) optionally tipping the tobacco rod with a cigarette filter using tipping paper. In one embodiment, the tipping paper can comprise catalytic paper.

While preferred embodiments of the invention have been described, it is to be understood that variations and modifications may be resorted to as will be apparent to those skilled in the art. Such variations and modifications are to be considered within the purview and scope of the invention as defined by the claims appended hereto.

All of the above-mentioned references are herein incorporated by reference in their entirety to the same extent as if each individual reference was specifically and individually indicated to be incorporated herein by reference in its entirety.

What is claimed is:

1. A method of manufacturing catalytic-precursor infiltrated cigarette paper comprising (i) supplying a cellulosic material to a first head box of a forming section of a papermaking machine, (ii) depositing an aqueous slurry from the first head box onto the forming section of the papermaking machine so as to form a base web comprising the cellulosic material, (iii) removing water from the base web so as to form an intermediate web, (iv) drying the intermediate web so as to form a finished web, and (v) depositing a catalyst precursor on the finished web to form a catalyst precursor-infiltrated web, wherein the catalyst precursor comprises iron nitrate, copper nitrate, manganese nitrate, iron ethoxide, iron ethyl hexanoisopropoxide and/or manganese (II) methoxide, and wherein catalyst particles are formed by thermal decomposition of the catalyst precursor or from a reaction between the catalyst precursor and moisture.

2. The method of claim 1, wherein the catalyst precursor is a dried powder that is dusted onto the finished web.

3. The method of claim 1, wherein the catalyst precursor comprises a mixture of two or more different catalyst precursor compounds.

4. The method of claim 1, wherein the catalyst precursor permeates the finished web.

5. A method of manufacturing catalytic-precursor infiltrated cigarette paper comprising (i) supplying a cellulosic material to a first head box of a forming section of a papermaking machine, (ii) depositing an aqueous slurry from the first head box onto the forming section of the papermaking machine so as to form a base web comprising the cellulosic material, (iii) removing water from the base web so as to form an intermediate web, (iv) drying the intermediate web so as to form a finished web, and (v) depositing a catalyst precursor on the finished web to form a catalyst precursor-infiltrated web, wherein catalyst particles are formed by thermal decomposition of the catalyst precursor or from a reaction between the catalyst precursor and moisture.

6. The method of claim 5, wherein the catalyst precursor permeates the finished web.

7. The method of claim 5, wherein the catalyst precursor is a dried powder that is dusted onto the finished web.

8. The method of claim 5, wherein the catalyst precursor comprises a mixture of two or more different catalyst precursor compounds.

* * * * *